US006009575A

United States Patent [19]

Hsieh

[11] Patent Number: 6,009,575

[45] Date of Patent: Jan. 4, 2000

[54] FOLDABLE BED ASSEMBLY

[76] Inventor: Chuan Chi Hsieh, No. 71, Nan An Rd., Tien Liao Hsiang, Kaohsiung Hsien, Taiwan

[21] Appl. No.: 09/153,050

[22] Filed: Sep. 15, 1998

[51] Int. Cl.[7] ..... A47C 19/12; A47C 17/64; A47C 19/02

[52] U.S. Cl. ..... 5/174; 5/178; 5/114; 5/306; 5/149; 5/510

[58] Field of Search ..... 5/174, 178, 179, 5/613, 617, 114, 305, 306, 307, 162, 149, 150.1, 152, 620, 510, 511

[56] References Cited

U.S. PATENT DOCUMENTS

| | | | |
|---|---|---|---|
| 246,028 | 8/1881 | Meyer | 5/178 |
| D. 257,623 | 12/1980 | Bue et al. | 5/510 X |
| 1,265,257 | 5/1918 | Schellinger | 5/510 X |
| 1,434,100 | 10/1922 | Creasy | 5/178 X |
| 3,456,269 | 7/1969 | Goodman | 5/178 |
| 4,879,774 | 11/1989 | Sanders | 5/510 X |

*Primary Examiner*—Terry Lee Melius
*Assistant Examiner*—Rodrigo J. Morales
*Attorney, Agent, or Firm*—Rosenberg, Klein & Lee

[57] ABSTRACT

A foldable bed assembly includes a mattress, a mediate supporter, a front frame having a first end pivotally connected to the mediate supporter, and a rear frame having a first end pivotally connected to the mediate supporter. A head frame is securely attached to a second end of the front frame and includes a lower end securely located on the ground to avoid sliding. A rear leg frame is securely attached to a second end of the rear frame. One of the front frame and the rear frame includes two handles respectively attached to two lateral sides thereof. Each handle includes an extension that is located between the front frame and the rear frame when the foldable bed assembly is in a folded status.

1 Claim, 5 Drawing Sheets

FOLDABLE BED ASSEMBLY

BACKGROUND OF THE INVENTION

1. Field of the Invention

The present invention relates to a foldable bed assembly that may prevent from injury to user during folding.

2. Description of the Related Art

FIG. 6 of the drawings illustrates a typical foldable bed assembly that includes a mattress 1', a front frame 2', a rear frame 3', and a middle supporter 6'. Attached to the front frame 2' are two legs 4' each having a caster 41' attached to a lower end thereof. Attached to the rear frame 3' is a leg structure 5' having a number of casters 51' secured thereto. The front frame 2' includes an inner frame that has an end pivotally connected to a front section thereof. A spring 21' is connected between a middle point of a lower rod of the middle supporter 6' and a middle point of a front end of the front frame 2', while another spring 31' is connected between the middle point of the lower rod of the middle supporter 6' and a middle point of a rear end of the rear frame 3'. Two handles 22' are respectively attached to two lateral sides of the front frame 2'. During folding, the springs 21' and 31' provide a relatively large force for moving the front and rear frames 2' and 3' toward each other, such that the user might be injured if his/her hands are happened to be in a position between the two frames 2' and 3'. In addition, misalignment might occur as the springs 21' and 31' are only connected to middle points of the frames 2' and 3' and the supporter 6'. Furthermore, the bed assembly can only be used when extended and thus occupies a considerable space. Further, the casters 41' and 5' are often mounted to the legs 4' and the leg structure 5' by soldering, which is time-consuming and inconvenient. The present invention is intended to provide an improved foldable bed assembly to solve this problem.

SUMMARY OF THE INVENTION

It is a primary object of the present invention to provide an improved foldable bed assembly that can be used even if in a folded status.

It is another object of the invention to provide an improved foldable bed assembly that may protect the user during folding.

It is a further object of the invention to provide an improved foldable bed assembly in which wheels can be easily attached to the legs thereof.

A foldable bed assembly in accordance with the present invention comprises:

a mattress, a mediate supporter having a first side and a second side, a front frame having a first end pivotally connected to the mediate supporter and a second end, the second end of the front frame having a first side and a second side, a rear frame having a first end pivotally connected to the mediate supporter and a second end, the second end of the rear frame having a first side and a second side, a head frame securely attached to the second end of the front frame and including a lower end securely located on the ground to avoid sliding of the bed assembly when the foldable bed assembly is in an extended status, a plurality of wheels being mounted to a side of the head frame that is opposite to the mattress when the foldable bed assembly is in the extended status, a rear leg frame securely attached to the second end of the rear frame, a first spring having a first end attached to the first side of the second end of the rear frame and a second end attached to the first side of the mediate supporter, a second spring having a first end attached to the second side of the second end of the rear frame and a second end attached to the second side of the mediate supporter, a third spring having a first end attached to the first side of the second end of the front frame and a second end attached to the first side of the mediate supporter, a fourth spring having a first end attached to the second side of the second end of the front frame and a second end attached to the second side of the mediate supporter, and one of the front frame and the rear frame including two handles respectively attached to two lateral sides thereof, each said handle including an extension that is located between the front frame and the rear frame when the foldable bed assembly is in a folded status.

The rear leg frame includes two legs each having a wheel mounted to a lower end thereof. In a preferred embodiment of the invention, the lower end of each leg includes two spaced walls having a slit defined therein for rotatably receiving the wheel, the walls having aligned holes defined therein. Two sleeves are respectively attached to two sides of the lower end of the leg, each sleeve having a length so sized to be fittingly received in an associated hole of the wall. An axle is extended through the sleeves, the aligned holes, and the wheel.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
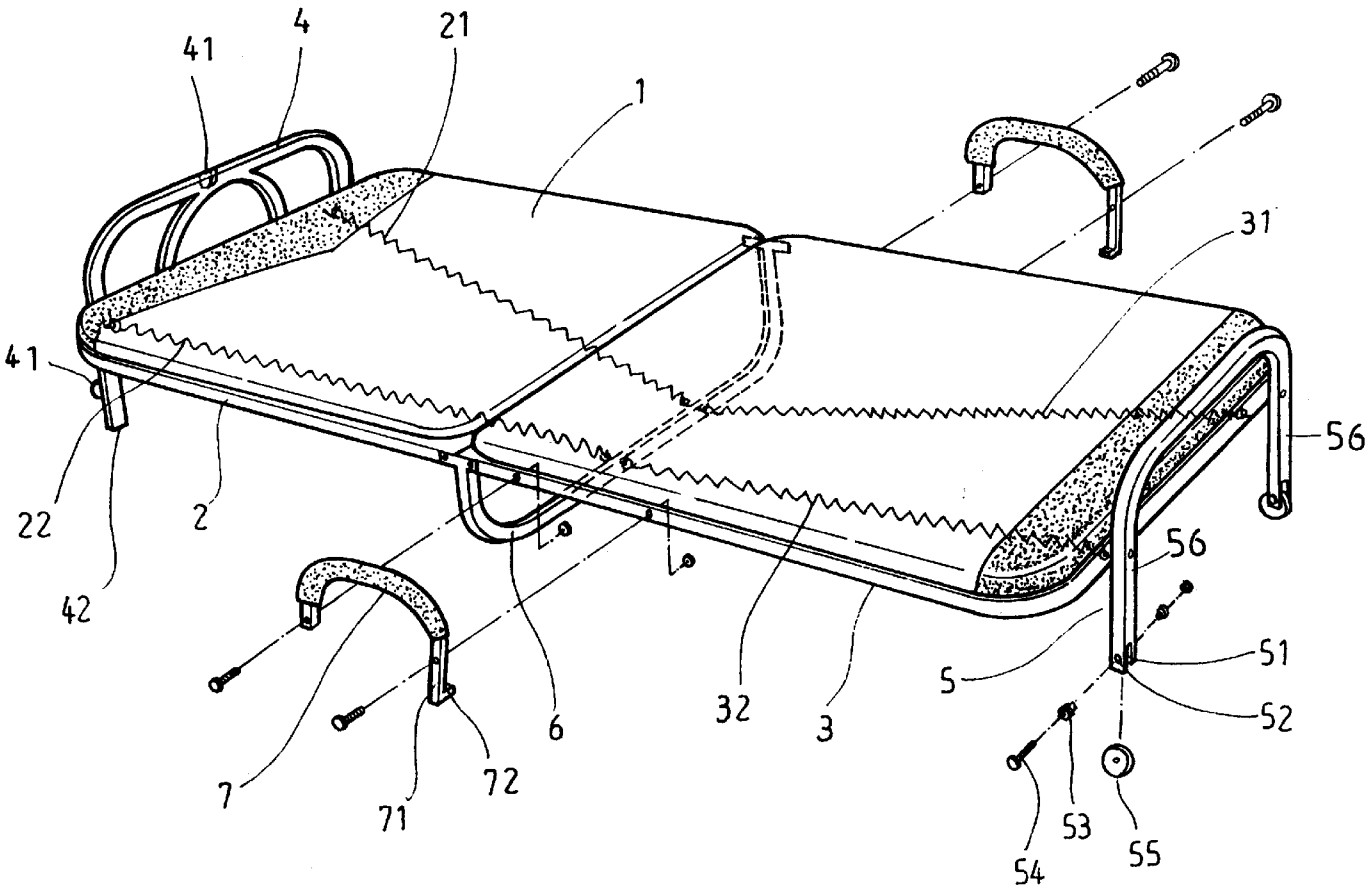
FIG. 1 is an exploded perspective view of a foldable bed assembly in accordance with the present invention.
Figure 2:
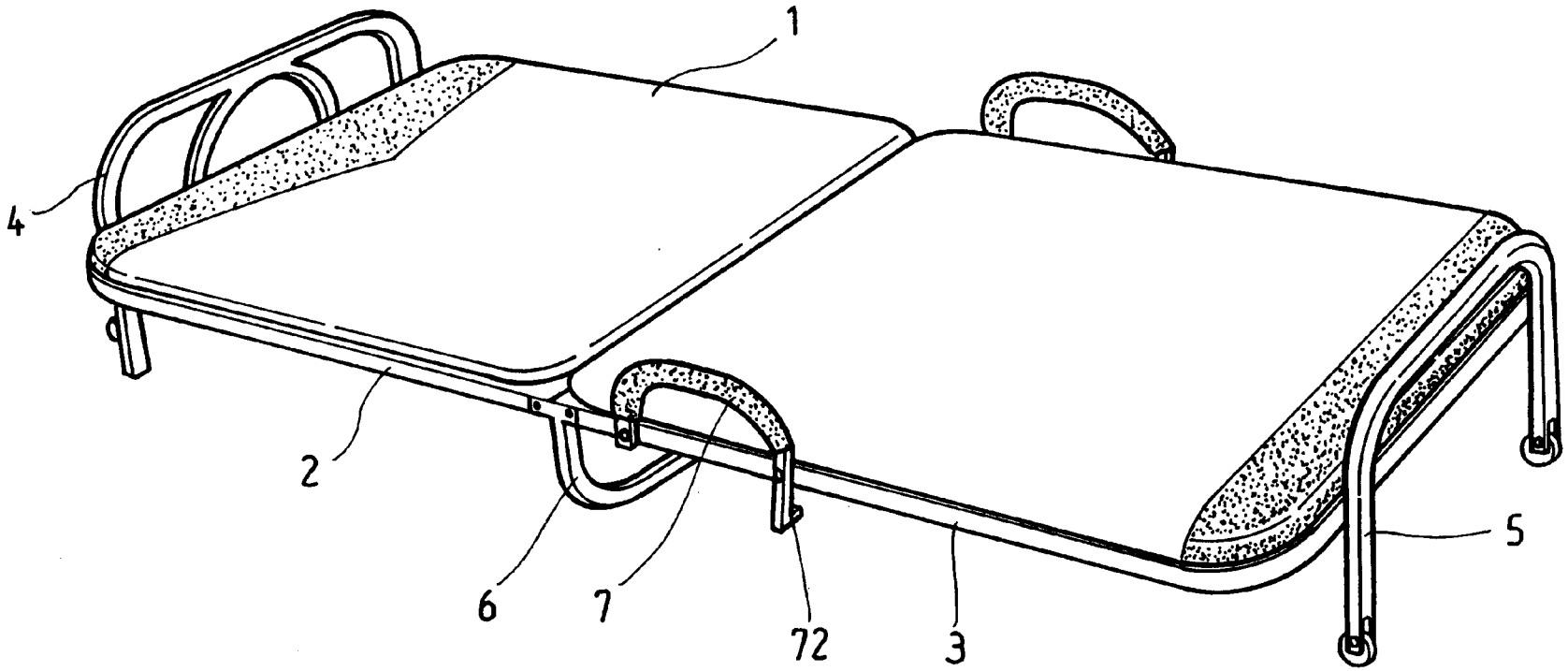
FIG. 2 is a perspective view of the foldable bed assembly in accordance with the present invention.
Figure 3:
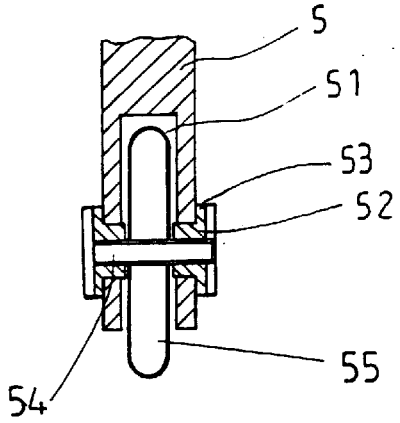
FIG. 3 is a sectional view illustrating a wheel attached to a leg of the foldable bed assembly in accordance with the present invention.
Figure 4:
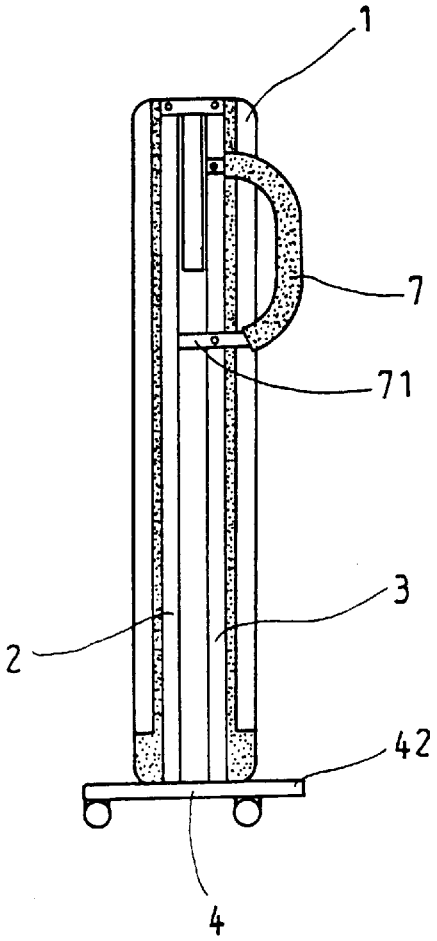
FIG. 4 is a side view of the foldable bed assembly in accordance with the present invention in a folded status.

Referring to FIGS. 1 to 5 and initially to FIGS. 1 and 2, a foldable bed assembly in accordance with the present invention generally includes a mattress 1, a mediate supporter 6, a front frame 2 having a first end pivotally connected to the mediate supporter 6, and a rear frame 3 having a first end pivotally connected to the mediate supporter 6. A head frame 4 is attached to a second end of the front frame 2 and includes a lower end securely located on the ground to avoid sliding of the bed assembly when extended. A number of wheels 41 are mounted to a side of the head frame 4 that is opposite to the mattress 1. A rear leg frame 5 is securely attached to a second end of the rear frame 3. The rear leg frame 5 includes two legs 56 each having a wheel 55 mounted to a lower end thereof. In this embodiment, the lower end of each leg 56 includes two spaced walls having a slit 51 defined therein for rotatably receiving the wheel 55, the walls having aligned holes 52 defined therein. Two sleeves 53 are respectively attached to two sides of the lower end of the leg 56, each sleeve 53 having a length so sized to be fittingly received in an associated hole 52 in the wall. And an axle 54 is extended through the sleeves 53, the aligned holes 52, and the wheel 55, best shown in FIG. 3. This avoids troublesome soldering of mounting casters in the conventional design.

As shown in FIG. 1, a first spring 31 has a first end attached to a first side of the second end of the rear frame 3 and a second end attached to a first side of the mediate supporter 6. A second spring 32 has a first end attached to a second side of the second end of the rear frame 3 and a second end attached to a second side of the mediate supporter 6. A third spring 21 has a first end attached to a first side of the second end of the front frame 2 and a second end attached to the first side of the mediate supporter 6. A fourth spring 22 has a first end attached to a second side of the second end of the front frame 2 and a second end attached to the second side of the mediate supporter 6. This arrangement may provide assistance to the user during folding by moving the two frames 2 and 3 toward each other, and misalignment of the front frame 2 and rear frame 3 is avoided.

Two handles 7 are respectively attached to two lateral sides of the rear frame 3 (or the front frame 2). Each handle 72 includes an extension 71 which has a stop 72 that will be located between the front frame 2 and the rear frame 3 when the bed assembly is in a folded status, best shown in FIG. 4. This may avoid injury to the user's hand during folding.

Figure 5:
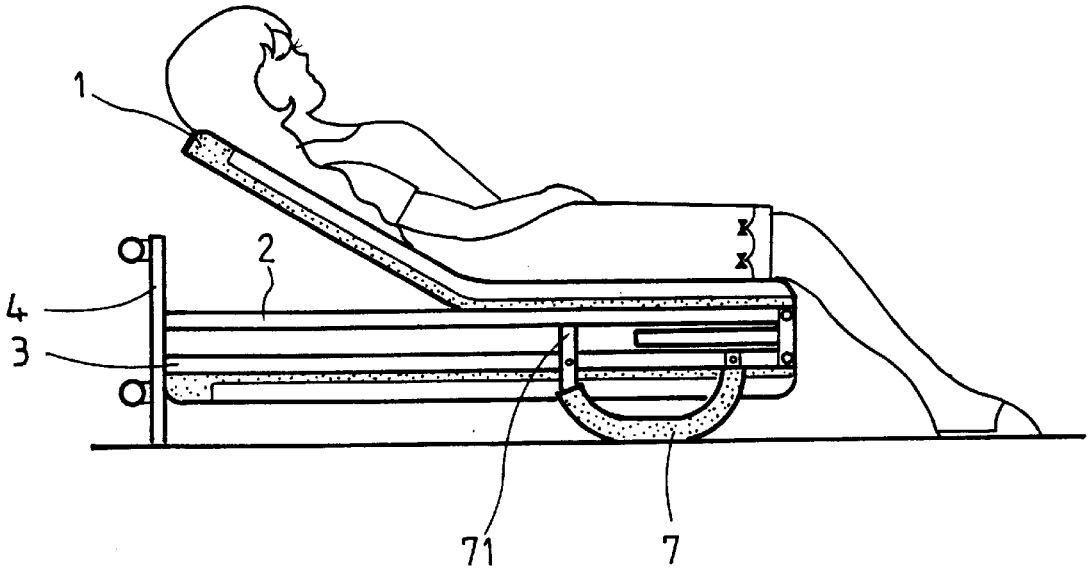
FIG. 5 is a side view illustrating use of the foldable bed assembly in accordance with the present invention in a folded status.
Figure 6:
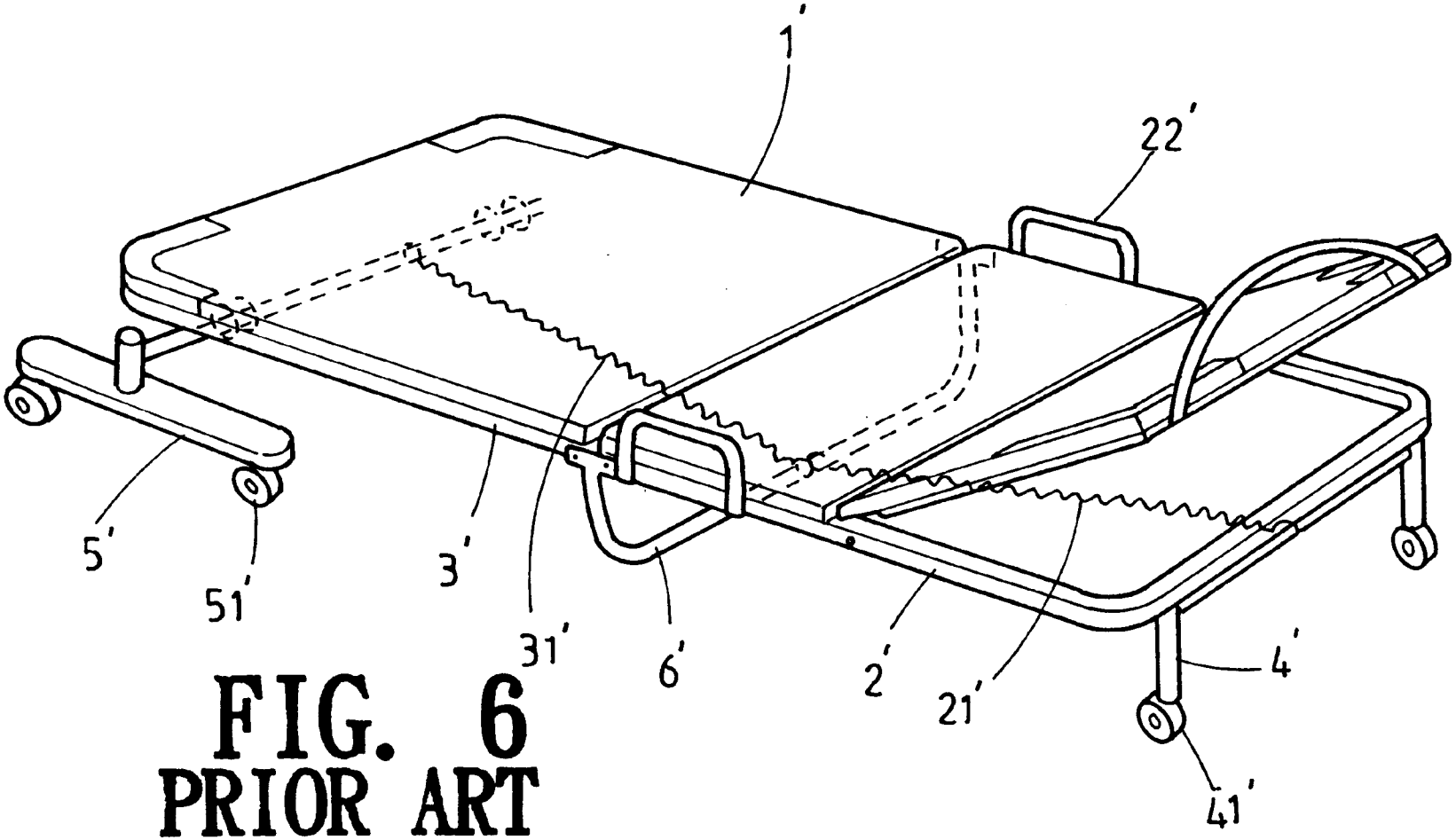
FIG. 6 PRIOR ART
FIG. 6 is a perspective view of a conventional foldable bed assembly.

Referring to FIG. 5, when folded, the bed assembly of the present invention still can be used by turning the folded bed assembly through 90° to a status shown in FIG. 5, while the front frame 2 may be adjusted to a status shown in this figure for resting.

According to the above description, it is appreciated that injury to the user's hands during folding is prevented. In addition, misalignment of the front frame 2 and the rear frame 3 is avoided. Furthermore, the bed assembly can be used in a folded status.

Although the invention has been explained in relation to its preferred embodiment, it is to be understood that many other possible modifications and variations can be made without departing from the spirit and scope of the invention as hereinafter claimed.

What is claimed is:

1. A foldable bed assembly, comprising:

a mattress, a mediate supporter having a first side and a second side, a front frame having a first end pivotally connected to the mediate supporter and a second end, the second end of the front frame having a first side and a second side, a rear frame having a first end pivotally connected to the mediate supporter and a second end, the second end of the rear frame having a first side and a second side, a head frame securely attached to the second end of the front frame and including a lower end securely located on a ground surface to avoid sliding of the bed assembly when the foldable bed assembly is in an extended status, a plurality of wheels being mounted to a side of the head frame that is opposite to the mattress when the foldable bed assembly is in the extended status, a rear leg frame securely attached to the second end of the rear frame, a first spring having a first end attached to the first side of the second end of the rear frame and a second end attached to the first side of the mediate supporter, a second spring having a first end attached to the second side of the second end of the rear frame and a second end attached to the second side of the mediate supporter, a third spring having a first end attached to the first side of the second end of the front frame and a second end attached to the first side of the mediate supporter, a fourth spring having a first end attached to the second side of the second end of the front frame and a second end attached to the second side of the mediate supporter, and a pair of handles respectively coupled to opposing sides of one of the front frame and the rear frame, each said handle having a pair of attachment portions respectively disposed on opposing ends thereof and a portion extending from one of said ends to contact the other one of the rear frame and the front frame and thereby limit a distance between the front frame and the rear frame when the foldable bed assembly is in a folded status.

* * * * *